United States Patent [19]

Tompkins

[11] 4,076,074

[45] Feb. 28, 1978

[54] HIGH EFFICIENCY NATURAL CONVECTION HEATING AND COOLING SYSTEM FOR HOME DWELLINGS

[75] Inventor: Leo L. Tompkins, Jackson, Miss.

[73] Assignee: Xenco, Inc., Jackson, Miss.

[21] Appl. No.: 690,820

[22] Filed: May 27, 1976

[51] Int. Cl.[2] ..... F24H 9/08; F24D 5/10

[52] U.S. Cl. ..... 165/53

[58] Field of Search ..... 165/48, 49, 53, 65; 62/DIG. 16

[56] References Cited

U.S. PATENT DOCUMENTS

| | | | |
|---|---|---|---|
| 2,767,961 | 10/1956 | Frankland | 165/53 X |
| 3,371,707 | 3/1968 | Weibull | 165/49 |
| 3,693,705 | 9/1972 | Stutz | 165/48 |
| 3,994,276 | 11/1976 | Pulver | 165/48 X |

*Primary Examiner*—Charles J. Myhre
*Assistant Examiner*—Theophil W. Streule, Jr.
*Attorney, Agent, or Firm*—Sughrue, Rothwell, Mion, Zinn and Macpeak

[57] ABSTRACT

A residential dwelling of the type having thermally insulated outer walls and a thermally insulated roof supported by an underlying floor and forming therebetween an essentially closed enclosure, is provided with a tubular vertical stack extending from the floor to the building structure ceiling which spans across the building beneath the roof and separates the attic from the lower occupant rooms. Floor ducts open to the bottom of the stack from the individual rooms and further air ducts within the ceiling open to the top of the stack by way of the attic. A selectively energizable air heating coil is mounted within the stack at its lower end and a selectively energizable air cooling coil is mounted within the stack at its upper end with natural convection effecting air flow through the stack in a given direction depending upon relative energization of the heating or cooling coil.

3 Claims, 1 Drawing Figure

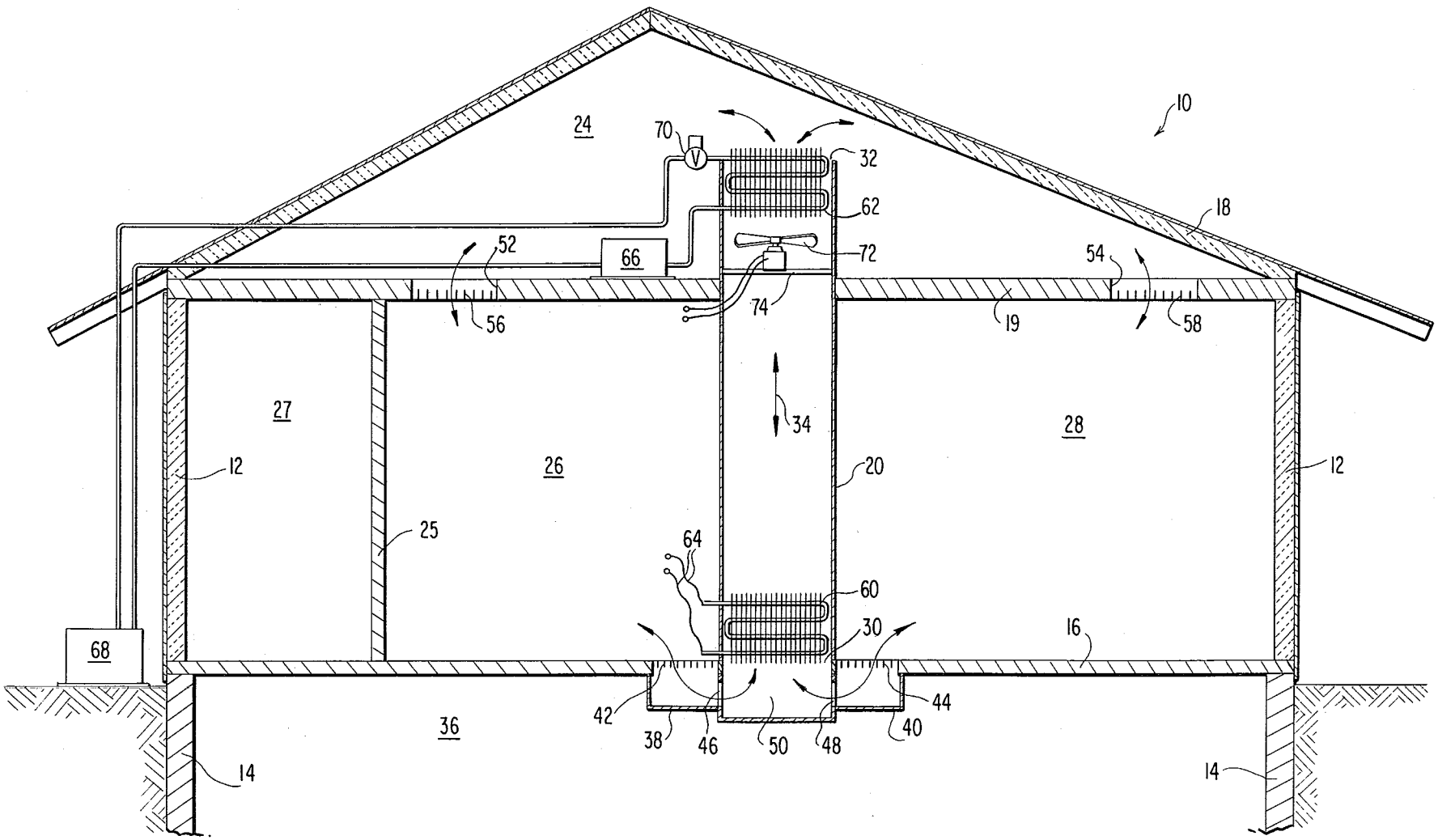
10
12
14
16
18
19
20
24
25
26
27
28
30
32
34
36
38
40
42
44
46
48
50
52
54
56
58
60
62
64
66
68
70
72
74

HIGH EFFICIENCY NATURAL CONVECTION HEATING AND COOLING SYSTEM FOR HOME DWELLINGS

BACKGROUND OF THE INVENTION

1. Field of the Invention

This invention relates to central heating and cooling systems for residential home construction and more particularly to an improved low energy, high efficiency natural convection system of simplified construction.

2. Description of the Prior Art

Central heating and cooling systems as employed in most residential dwellings use forced air to transport heat or cool to the various rooms. In that regard, a single direction of flow is provided and the heated or cooled air must be delivered against the natural convection forces due to the change in the weight of the air as it is heated or cooled. Fans or blowers are required to force the air after being heated or cooled by passage over heat exchange coils to pass through relatively small ducts which adds to the loading. Such systems are known as high velocity injection systems, and for economy, the ducts are relatively small in size for the purpose of effecting maximum mixing of the air in the room where the air is being delivered. Actually, the air is delivered at a temperature which is quite different from the comfort level and mixing is needed to reduce the shock of highly contrasting air pockets and to catch the room corners and other places where the heat is being lost or gained to the extent that the conditioning is being locally distributed.

The high velocity is especially required when correction air is injected against gravity, as where the cool air is injected at the ceiling and the return is at the floor. If it were not for complete mixing, the cool air would go to the floor and return without much correction of the air in the room. In the reverse, the same is true of heating air which rises to the ceiling and creates a hot pocket if complete mixing is not accomplished. Such systems, partially due to the forced nature of the air, create objectionable drafts which are most noticeable in cold weather.

The present invention makes use of a simplified concept of natural convection which has been in use as far back as recorded history. For instance, the basic concept of natural convection is employed in coal furnaces which are placed in the basement of houses and heated air is sent to the rooms by convection through ducts, the air naturally rising to circulate through the various rooms on the given levels. Many dwellings in various times and places have been heated by convection outside the range of radiant heat from surfaces heated by direct contact with the fire, fireplace, pot belly stove, and the like.

The present invention adds to the natural convection to provide heating to the various rooms of a residential dwelling or the like, the same natural convection technique in the passage of air to be cooled over a cooling coil and employs the cooled air as its own means for distributing uniformly the cooling effect to the various rooms without objectionable drafts, etc.

The present invention employs low velocity, low temperature difference and maximum displacement of the air in a home with as little mixture as possible, does not reject a portion of the air within the building or replace the portion rejected and permits a layered movement of the air completely through the building structure being cooled and heated by convection to provide maximum efficiency and low energy heating and cooling to a residential dwelling or like building.

SUMMARY OF THE INVENTION

The low energy, draft free, convection cooling and heating system of the present invention is applied to a home dwelling which comprises a building structure including insulated outer walls and an insulated roof supported by an underlying floor and forming an essentially closed enclosure. A horizontal ceiling within the building separates the enclosure into an upper attic and at least one lower occupant room. A closed tubular stack extends vertically within the building from the floor to the ceiling. First air ducts open to the room at the level of the floor lead to the lower end of the stack, and second air ducts mounted within the ceiling are open to the top of the stack. A selectively energizable heating coil is mounted within the stack at its lower end for heat exchange with the air within the stack and a selectively energizable cooling coil is mounted within the upper end of the stack for selective heat exchange with the air within the upper end of that stack, whereby in the heating mode air at the bottom of the stack is warmed by the heating coil and rises naturally by convection until the column of air in the stack is lighter than a similar column in the room. The excess weight of the air in the room serves to push the colder air near the floor into the lower duct and displace the lighter air in the stack near the heating coil and draft free circulation of air occurs between the room and the stack. In cooling, the column of air in the stack is cooled to a greater degree than that within the room by the cooling coil at the top of the stack when cooling is needed, and this air flows at low velocity through the first air ducts into the room to displace the warmer air through the second air ducts within the ceiling into the stack to replace the cold air carried thereby. A low velocity fan mounted within the stack may add low velocity forced flow to the natural convection induced air flow in either heating or cooling mode.

BRIEF DESCRIPTION OF THE DRAWING

The single FIGURE is a sectional elevational view of a one story residential dwelling building incorporating the improved high efficiency natural convection heating and cooling system of the present invention.

DESCRIPTION OF THE PREFERRED EMBODIMENT

Reference to the single FIGURE illustrates an enclosed building structure 10 constituting a residential dwelling of one story in height which includes external thermally insulated walls 12 extending vertically upward from a floor 16 which in turn is supported by a conventional cinder block foundation or the like 14, the enclosed building structure 10 being completed by a thermally insulated roof indicated at 18. Spanning between the walls 12 is a conventional ceiling 19 which is horizontal and forms with respect to the roof 18 an attic or space 24 and separates the attic 24 from occupant's rooms such as 26 and 28 to each side of a vertical stack 20 which constitutes a basic element of the convection heating and cooling system of the present invention. A single vertical partition 25 is shown within room 26, separating that room from an anteroom 27, the partition 25 simply indicating the conventional nature of the building structure which may employ a plurality of different rooms separated by suitable vertical partitions. The stack 20 which is preferably rectangular in horizontal cross section is formed of sheet metal or an insulation board is open at its lower end at 30 adjacent the floor 16, while at its upper end it is also open at 32 at a point within attic 24 beneath the roof 18 but well above the ceiling 19. The stack 20 therefore forms a natural vertical flue for natural convection of air within the stack 20 as shown by the double headed arrow 34 in either a vertical upward or vertical downward direction depending upon whether the stack air is cold or warm relative to the air within respective rooms 26 and 28 of the building structure 10.

Within the cellar 36 beneath the floor 16 and within the area of foundation 14, there is provided a pair of horizontal ducts as at 38 and 40 underlying respective rooms 26 and 28 and being open to those rooms by means of louvered openings 42 and 44 respectively. In turn, the horizontal ducts 38 and 40 are provided with openings 46 and 48 which open up to a central recessed area of floor 16 as at 50, constituting a vertical extension of stack 20. While in the illustrated embodiment, the opening 32 within the upper end of the stack 20 opens directly to attic 24 and the attic 24 further acts as duct means to the various rooms 26 and 28 by way of ceiling openings 52 and 54 controlled by louvers 56 and 58. Closed ducts may in fact extend from the upper end of the stack 20 to the openings 52 and 54 within the ceiling to effect circulation of air by convection generated within the stack 20 as will be discussed hereinafter, closed ducts leading from the stack 20 to ceiling openings 52, 54 could suffice.

It is important only in the present invention that each of the rooms such as rooms 26 and 28 have one opening within the ceiling leading to the upper end of the stack 20, and a further opening as at 42 and 44 be provided with respect to the lower end of the same stack leading to the rooms at floor level. The present invention requires the presence of a heating coil such as electric coil 60 fixedly mounted within the lower end of the stack 20 in the vicinity of the floor 16, while the duct further carries a cooling coil as at 62 fixedly mounted within the upper end of stack 20 adjacent opening 32. The electric heating coil 60 is selectively connected to an electrical source (not shown) by way of electrical leads 64. Cooling coil 62 may constitute the evaporator coil of a conventional Freon refrigeration systeml. Compressor 66 is mounted on the ceiling 19 within attic 24 and is connected in a closed series loop with the evaporator coil 62 and outdoor condenser coil 68. Expansion of the refrigerant from the condenser is controlled by a conventional thermal expansion valve 70. As mentioned previously, while the basis of the invention involves natural convection and displacement of the air within the stack by a temperature differential between that air and the air within the various rooms, a small low velocity electric fan 72 is shown as being positioned beneath the cooling coil 62 supported by means of a bar 74 so as to be of minimum impedance to the flow of air through the stack 20. The fan is selectively energized if necessary either manually or automatically by means (not shown) if natural convection is insufficient to maintain the desired temperature within the rooms 26 and 28.

The system as described constitutes, therefore, a closed circuit for air to flow in either direction as shown by arrow 34 from stack 20 to the rooms 26, 28 through the openings 52 and 54 within the ceiling and return through louvered openings 42 and 44 within the floor 16 and ducts 38 and 40 to the lower end of the stack or vice versa, with the heating and cooling coils 60 and 62 being physically located at a point where maximum circulation occurs by convection due purely by heating and cooling of the air at that loation.

In the heating mode, the air at the bottom of the stack 20 is warmed by the heating coil 60 upon energization of that coil. The air within the stack 20 becomes lighter and rises within the stack to mix with other air in the stack until a column of air within stack 20 is lighter than a similar column within a room 26 or 28. The excess weight of the air in the rooms serves to push the colder air near the floors through the louvered openings 42 and 44 into the lower end of stack 20 to displace the lighter air in the stack near the heating coil and the new air is heated in turn. This movement creates a pressure differential between the air at the top of the room at ceiling openings 52 and 54. This serves to cause the warm air to flow through the openings 52 and 54 within the ceiling and to replace the colder air which leaves the room at the bottom near the floor 16 and enters the lower end of the stack 20. By concentrating the heating at the bottom of the stack 20, the entire height of the column of air will be heated to the desired temperature and maximum convective force is created to achieve better circulation. Further, with the present system, there is no necessity to heat the air much warmer than that needed in the room. Appropriately, a thermostat (not shown) at the top of the stack will effectively cycle the energization of the electrical heating coil 60 to limit the temperature.

A continuous circulation of air is established through the rooms as long as there is cold air at the floors, and the coldest air is removed from the floor of the rooms while the warmed air is introduced at the ceiling through ceiling openings 52 and 54 to spread across the area of the rooms and settle through the rooms as it is replaced at the ceiling by the next layer. Air that is cooled by contact with the outside walls and windows will settle to the floor ahead of the other air that is not so cooled and will leave the room first. There is less draft this way than with the methods referred to previously which mix the warm air with the air that is already in the room, removing some of the air that is so mixed. Less heat need be moved into the room to maintain a given temperature by the system of the present invention. The incoming air does no have to be as warm as if it were to be mixed and a lower temperature source can be used for heating the air. Obviously, a steam coil or a hot water coil could be employed in lieu of the electric heating coil 60 within the lower end of stack 20. The use of a lower temperature source greatly increases the capacity and efficiency of heat storage and uses sensible heat in that storage. This is an important advantage when using stored heat derived from solar collectors, for instance.

When heat no longer needs to be added to the air, the thermostat mentioned previously simply will not energize the coil 60. If the room becomes overheated, the thermostat simply shifts the system into a cooling mode and this causes the refrigeration system to become energized such that refrigerant gas at high pressure expands within the evaporator coil 62 under control of the expansion valve 70 to remove heat from the air in the vicinity of coil 62 within the upper end of stack 20. In cooling the air at the top of the stack, the cool air falls down within the stack 20 to form a column of air that is heavier than a similar column in room 26 and 28. The heavier air in the stack flows through the lower ducts 38 and 40 and vents to the floor by way of louvered openings 42 and 44 of the various rooms to displace the warmer layers at the floors. Warm air at the ceiling leaves the room through the ceiling openings 52, 54 and by convection moves to the top of the stack where it enters opening 32 to replace the cooled air that settles down the stack and it in turn becomes cool by the latent heat of evaporation of the refrigerant within the evaporator coil 62. Thus, again, a continuous flow of air is established at low velocity due to convection which rises through the rooms as each new layer is supplied by the stack, displacing the layer ahead of it, and the hotest air is returned to the upper end of stack 20 first. Heat inflow into the rooms warms the air in contact with the surface conducting the heat and those particles of air rise ahead of the air that is cooler and only the hotest air is removed at any time. The rooms can be cooled in this way using a higher temperature source of cool air than with methods that mix the air in the room and remove part of the mixed air. There are no objectionable drafts under the method of the present invention. The higher source temperature for effective cooling is a distinct advantage when using water as a cold sink in a system, for instance, which would replace the refrigeration system illustrated by a cold sink and a means for supplying relatively cold water to the cooling coil 62.

Preferably, the stack comprises an essentially vertical ductwork through the height of the house from floor to ceiling. A central location with respect to the structure itself is an advantage, and the coil size of the heating and cooling coils should be such that the coils do not cover most of the area for effective convection leaving a major area for free passage of the air through the stack. In lieu of the use of the attic 24 as a portion of the duct means from the stack to the ceiling openings, an enclosed ductwork may be provided. Further, in the absence of effective thermal insulation within the roof, the ducts themselves as well as the stack could be thermally insulated to reduce unwanted heat loss or heat accumulation by the air flowing between the stack and the ceiling openings.

While the invention has been particularly shown and described with reference to a preferred embodiment thereof, it will be understood by those skilled in the art that various changes in form and details may be made therein without departing from the spirit and scope of the invention.

What is claimed is:

1. A high efficiency convection heating and cooling system for a residential dwelling building structure, said building structure including:

outer walls, an overlying roof and an underlying floor, a ceiling extending across said building between said roof and said underlying floor and forming the top of at least one room and defining with said roof an attic, the outer walls, the overlying roof and the underlying floor being insulated and forming a relatively closed insulated enclosure including said at least one room, a closed vertical stack extending vertically within the center of said building structure from said floor and through said ceiling and terminating just beneath said roof, said stack comprising a tubular duct of maximum length from the floor through the ceiling and into said attic, said cooling coil being located within said stack at a level above said ceiling adjacent the open upper end of the same, selectively energizable heating coil means mounted within said tubular duct at the lower end thereof in the vicinity of said floor to maximize lifting effort with respect to the heated air heated at the bottom of the stack and to maximize the dropping effort of the air cooled at the upper end of said tubular duct, first air duct means extending from said at least one room in the vicinity of said floor to the lower end of said tubular duct, second air duct means extending from the top of said at least one room to the top of said stack, said second air duct means comprising openings within the ceiling remote from said tubular duct for facilitating air flow by convection through said vertical tubular duct, said room and said first and second air duct means;

whereby, selective energization of said heating means effects heating of the air within said tubular duct to a greater degree than the air within said room to effect natural convection of air flow through said tubular duct in an upper direction to displace cold air within said tubular duct while selective energization of said cooling means within said tubular duct causes said air within said tubular duct at the top to cool to a greater degree than that within said at least one room to effect downward convection movement of said air within said tubular duct to provide draft free conditioning of the air within said at least one room.

2. The convection heating and cooling system as claimed in claim 1, wherein said floor comprises a recessed portion concentric with said duct and underlying the same, said first duct means comprises a duct member open at one end to said recessed portion beneath said stack and open at the other end directly through said floor into said at least one room, and wherein said cooling means comprises a cooling coil fixedly mounted within said stack at the level of said floor.

3. The convection heating and cooling system as claimed in claim 1, further comprising a low velocity reversible fan mounted within said tubular duct intermediate of said heating and cooling means for forcing air flow through said stack in addition to that achieved by natural convection.

* * * * *